US012178331B2

(12) United States Patent
Long

(10) Patent No.: US 12,178,331 B2
(45) Date of Patent: Dec. 31, 2024

(54) SAFETY BASSINET ADAPTER

(71) Applicant: Patricia Long, Santa Barbara, CA (US)

(72) Inventor: Patricia Long, Santa Barbara, CA (US)

( * ) Notice: Subject to any disclaimer, the term of this patent is extended or adjusted under 35 U.S.C. 154(b) by 385 days.

(21) Appl. No.: 17/482,414

(22) Filed: Sep. 22, 2021

(65) Prior Publication Data

US 2022/0007854 A1 Jan. 13, 2022

Related U.S. Application Data

(63) Continuation-in-part of application No. 17/232,860, filed on Apr. 16, 2021, now abandoned.

(60) Provisional application No. 63/014,539, filed on Apr. 23, 2020.

(51) Int. Cl.
*A47D 15/00* (2006.01)

(52) U.S. Cl.
CPC ..... *A47D 15/008* (2013.01)

(58) Field of Classification Search
None
See application file for complete search history.

(56) References Cited

U.S. PATENT DOCUMENTS

2005/0005353 A1* 1/2005 Waldman ..... A47D 9/012 5/101
2008/0141457 A1* 6/2008 Forshpan ..... A47D 15/008 5/100
2013/0185867 A1* 7/2013 Long ..... A47D 13/08 5/100
2016/0309912 A1* 10/2016 Long ..... A47D 9/012
2017/0007029 A1* 1/2017 Grubb ..... A47C 17/40

* cited by examiner

*Primary Examiner* — Adam C Ortiz
(74) *Attorney, Agent, or Firm* — Guy Cumberbatch

(57) ABSTRACT

An adapter for a bassinet that enables a mother to easily access an infant therein and provides a safety feature to prevent the infant from falling out. The bassinet has a plurality of enclosure walls surrounding a floor, and one of the walls is convertible between the raised configuration and a lowered configuration. The bassinet adapter has a generally planar main platform that fits within the bassinet walls and is supported by a floor of the bassinet. A partial barrier wall extends vertically upward from a front edge of the main platform which is located just inside the convertible wall. The partial barrier wall projects upward from the lowered convertible wall to present a barrier to the infant rolling out of the bassinet. The bassinet adapter may be clipped onto a fixed front lip of the bassinet extending parallel to the convertible wall and lower than the convertible wall in the raised position.

20 Claims, 13 Drawing Sheets

SAFETY BASSINET ADAPTER

RELATED APPLICATIONS

The present application is a continuation-in-part of U.S. patent application Ser. No. 17/232,860, filed Apr. 16, 2021, which claims priority under 35 U.S.C. 119 to U.S. Provisional Application Ser. No. 63/014,539, filed Apr. 23, 2020, the contents of which are expressly incorporated herein.

FIELD OF THE INVENTION

This invention relates generally to bassinets and, more particularly, to an adapter for a bassinet that enables a mother to easily access an infant therein and provides a safety feature to prevent the infant from falling out.

BACKGROUND OF THE INVENTION

The American Academy of Pediatrics states that the risks of co-bedding with a newborn, outweighs the benefits, and therefore, a mother should co-sleep (have the newborn at close proximity, but on a separate sleeping surface), and NOT co-bed with their newborn.

While most mothers will choose not to sleep in bed with their newborn, many fall asleep while they are feeding their infant. Further, even if the mother does not unintentionally fall asleep, when she tries to transfer her newborn to a separate surface after feeding, the newborn will awake and start to fuss or cry.

Many mothers still choose to sleep in bed with their newborns (bed sharing or co-bedding). There is research supporting a mother co-bedding with her newborn, stating that the mother is cued in to her newborn's movements, and will awaken if her newborn stirs or moves while in the mother's bed. In fact, most mothers who sleep with their infants will awaken when the infant starts to stir. Also, research has shown that the newborn benefits in many ways being in close proximity to its mother.

The problem is that mothers are totally exhausted from waking every few hours to feed their newborn. Oftentimes, a mother who has just had a baby, may unintentionally fall asleep while feeding and/or holding her infant. Falling asleep while holding her newborn, a mother can unintentionally let go of her newborn, which can result in a newborn falling out of the maternal bed. There are also reported incidences of a mother accidentally suffocating her newborn after falling asleep while the newborn is in bed with her. Even though most mothers awaken and move away from the newborn, they are still suffering from never going into a deep sleep for months, and the sleep deprivation can lead to anxiety and depression.

U.S. Pat. Nos. 9,226,594 and 10,149,551, both to Long, disclose safety bassinets that keep the newborn safe, should the mother unintentionally fall asleep while breast feeding her baby. This is particularly helpful for night feedings, as mothers are particularly susceptible to falling asleep unintentionally during this time. However, adoption of these safety bassinets is not universal for various reasons including cost.

In an effort to improve outcomes for mothers and infants, a more economical bassinet which is both comfortable for the mother and the safe for the baby is needed.

SUMMARY OF THE INVENTION

The present application provides an adapter for a bassinet that enables a mother to easily access an infant therein and provides a safety feature to prevent the infant from falling out.

The present disclosure provides an insert that sits under the newborn's mattress, allowing the mother to hold and feed her newborn while the newborn rests inside the bassinet. The insert may have a hill-shaped barrier, designed to prevent the newborn from rolling off the sleeping platform and prevent the mother from leaning too far inside the infant's sleeping space, while still allowing the mother to hold and feed her newborn.

The insert may consist of a firm platform that has hinged legs, allowing the newborn's mattress to be raised to a flush position when a side wall is lowered. Further, the hinged hill-shaped barrier can be either fixed, or can be made to clip on to any infant's platform that infant's mattress lays on. The hill shaped barrier is placed front and center to the side facing the mother, thus preventing the newborn from rolling off the mattress while the mother is interacting with her newborn. The mother would be able to place her arms inside the bassinet, on either side of the hill shaped barrier. Then, the mother's arms can rest on the newborn's mattress, providing her with arm, back and neck support while cradling her newborn in her arms, when the mother is in the sitting position. The mother may also access her newborn while she is in a side-lying position in bed, while the barrier prevents mother and infant from rolling on to their separate sleeping surfaces.

Should there be an automatic returning side wall made of a solid or a mesh material, the mother's arms would hold the side wall down, and when she lifts her arms, the side wall would be restored to its original upright position by use of a spring-loaded mechanism.

The middle barrier can be a fixed hinge device, mounted to a flat piece of plastic that the newborn's mattress rests on, or can be a snap-on: removable design. It can be made of soft or rigid plastic, or it can be made of a breathable mesh material

BRIEF DESCRIPTION OF THE DRAWINGS

Features and advantages of the present invention will become appreciated as the same become better understood with reference to the specification, claims, and appended drawings wherein:

DETAILED DESCRIPTION OF THE PREFERRED EMBODIMENTS

The bassinet adapter disclosed herein keeps the newborn on its own sleeping surface while the mother breast feeds, will also prevent the mother from having to transfer the newborn. A newborn easily awakens when moved from its mother's arms to a separate sleeping surface, so not having to transfer the sleeping newborn to another surface provides an easier way for the mother to keep her newborn from being disturbed after a feeding. Also, should the mother fall asleep and moves her arms out of the adapted bassinet, a convertible side wall will automatically spring back to its original upright position. The adapted bassinet should have the capacity to be placed onto or over the mother's mattress, bringing the newborn close to its mother to feed, and thus the adapted bassinet can be separate or can be attached to a stand that is parallel to the mother's bed.

Figure 1:
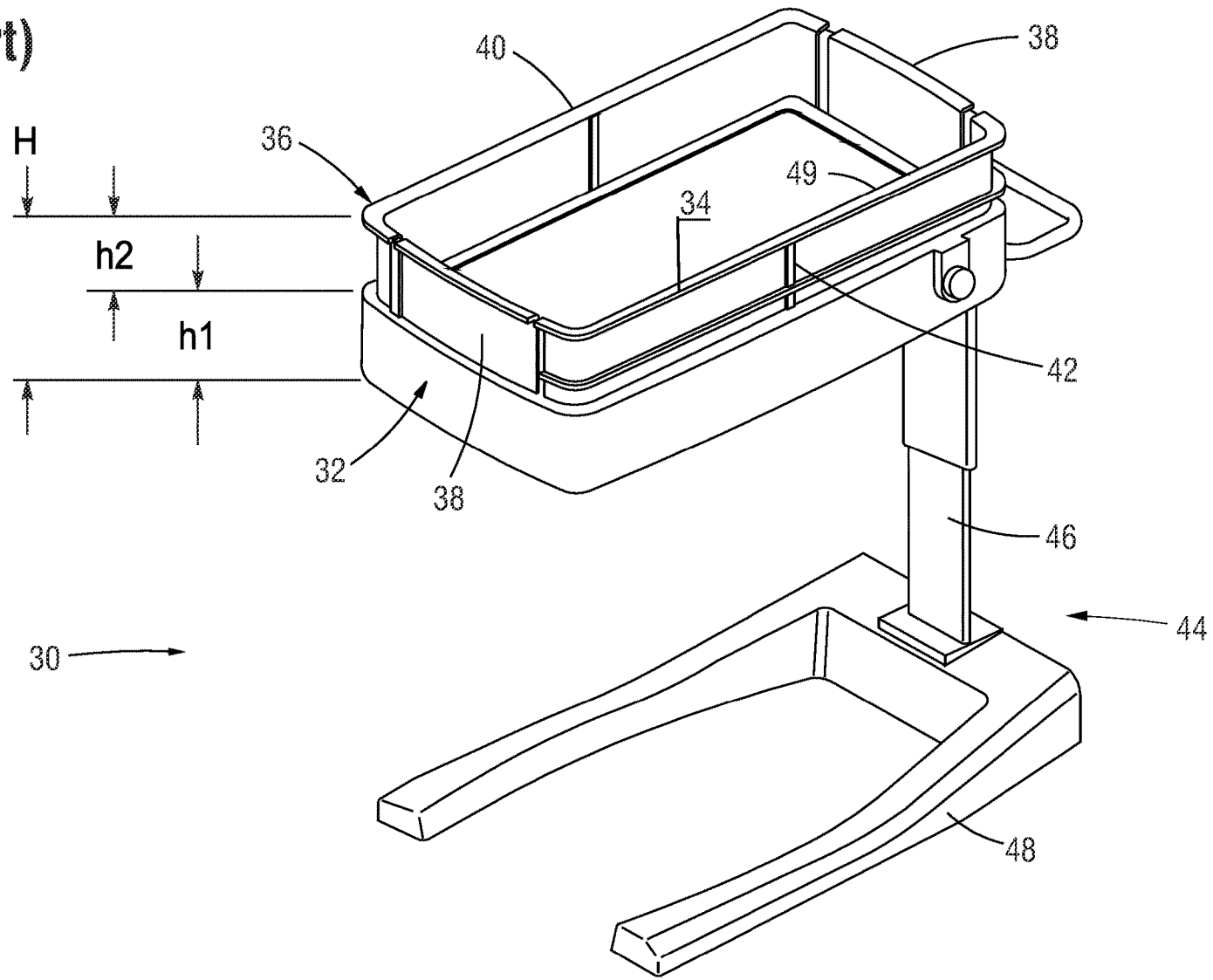
FIG. 1 (Prior Art)
FIG. 1 is a perspective view of an over-the-bed easy-access bassinet of the prior art which illustrates aspects of an over-the-bed stand for use with the bassinets disclosed herein.

FIG. 1 shows a bassinet 30 as disclosed in U.S. Pat. Nos. 8,429,771 and 9,226,594 to Long having a frame 32 on which is mounted a sleeping platform 34 surrounded by an upstanding enclosure 36. The enclosure 36 comprises end walls 38, a rear wall 40, and a front wall 42. In the illustrated embodiment the enclosure 36 defines a rounded rectangular shape with parallel end walls 38 being shorter in horizontal span than the parallel rear wall 40 and front wall 42. As will be described below, the front wall 42 converts between an elevated position presenting a barrier to an infant rolling off the sleeping platform 34 on that side and a lowered position in which the barrier is substantially removed. Although only the front wall 42 is shown as convertible, other walls or portions of the enclosure 36 may be convertible to increase the number of approaches for reaching in to the bassinet.

U.S. Pat. Nos. 8,429,771 and 9,226,594 to Long and expressly incorporated herein disclose a variety of different "easy-access" bassinets the details of which are expressly incorporated herein. The bassinets in Long are desirably mounted on an upright stand that is used to locate and support the bassinet over the mother's bed. In this respect, FIG. 1 illustrates an exemplary stand and is included to explain preferred aspects of such stands. The remaining drawings included herein do not show stands, but it should be understood that mounting the bassinets on an over-the-bed stand such as in FIG. 1 is a preferred configuration, and the absence of a stand in any drawing herein does not imply that that particular bassinet is not designed for such a support.

Referring back to FIG. 1, the frame 32 mounts on an upper end of a stand 44 having a support member 46 extending upward from a stabilizing base 48. The support member 46 may include structure to enable height adjustment, such as telescoped beams. Indeed, a power-assisted height-adjust mechanism, such as in hospital beds, may be included. The bassinet 30 can thus be raised or lowered to accommodate varying bed heights, and to assist nurses caring for the baby, such as allowing the nurse to lift the baby without having to bend over too far.

As mentioned, the bassinet 30 desirably describes a C-shape with the base 48 able to fit under a bed, while the frame 32 and sleeping platform 34 extend over the bed. That is, the stand 44 supports the lower frame 32 in a cantilevered manner so that the bassinet 30 may be positioned over a bed. In this regard, the base 48 can be raised and lowered to accommodate different bed heights. It should be noted, however, that certain features of the convertible enclosure may be suitable for other configurations of over-the-bed bassinets, and even for bassinets that are not designed to go over a bed.

The front wall 42 in the embodiment of FIG. 1 converts between its elevated and lowered positions by vertical displacement relative to the frame 32. That is, the front wall 42 maintains a generally vertical orientation and slides downward relative to the frame 32 and to the adjacent end walls 38. In one embodiment, the front wall 42 slides downward into the frame 32 to conceal its moving parts. For instance, the total height H of the frame 32 and enclosure 36 may be approximately twice the heights h1, h2 of the frame and enclosure, respectively. A space or cavity within the frame 32 receives and conceals the front wall 42 as it descends (not shown). Various structures to enable this particular sliding mechanism are described in U.S. Pat. Nos. 8,429,771 and 9,226,594 to Long.

In use, a mother lying on a bed may reach over the enclosure to cradle the baby, at the same time resting her arms on the front wall 42 which descends into the frame 32. The lowered position of the front wall 42 coincides with an upper edge 49 thereof being approximately at the level of the sleeping platform 34, or a mattress placed thereon. This removes the peripheral barrier from around the sleeping platform 34 and the mother's arms can rest comfortably over the lowered front wall 42 which is preferably rounded to eliminate sharp corners. The baby remains on the sleeping platform 34. This configuration is particularly comfortable for an extended period of breast-feeding, for example. The front wall 42 is also desirably mounted in the bassinet 30 with a restoring mechanism such as a spring that causes it to automatically return toward the elevated position from the lowered position in the absence of an external force or barrier, such as the mother's arms draped over the wall. When the mother desires to place the sleeping baby back into the enclosure 36, or if she happens to doze off while breast-feeding, the baby remains on the sleeping platform 34 and removal or relaxation of the mother's arms removes a downward force on the front wall 42, which permits it to return toward its elevated position.

Although U.S. Pat. Nos. 8,429,771 and 9,226,594 to Long describe numerous convertible bassinets, the opportunity remains for more comfortable and easier to clean bassinets, as will described below. Nevertheless, certain aspects described herein may be incorporated into the bassinet designs disclosed in the patents to Long, and thus, again, the disclosures in U.S. Pat. Nos. 8,429,771 and 9,226,594 are expressly incorporated herein.

One very useful aspect of the bassinets disclosed herein is at least one mesh wall that serves as the convertible wall. Such a mesh wall may include an elastic top edge that can easily be pushed down by the mother to reach in to care for the newborn. Further, the mesh wall may be removable so that it can be taken off and washed after a period of use. Additionally, a supplemental partial wall is desirably included within the bassinet and behind the convertible wall.

The partial wall is intended to remain in place while the mother cares for or feeds the baby to provide a constant barrier to the baby rolling out of the bassinet when the convertible wall is down. Specific embodiments of these aspects are shown and described below.

Figure 2:
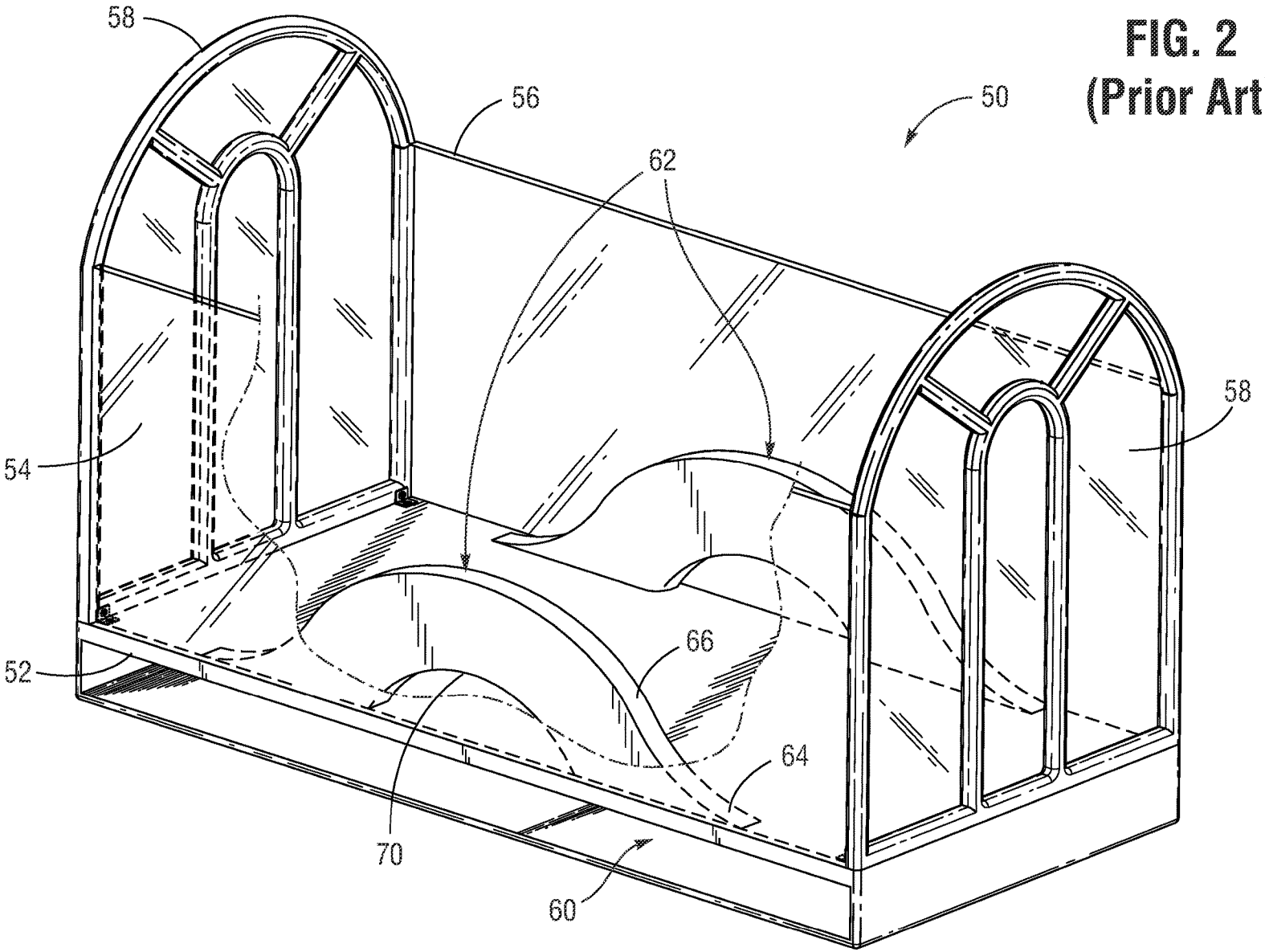
FIG. 2 (Prior Art)
FIG. 2 is a perspective view of an easy-access bassinet of the prior art which illustrates a partial barrier used in conjunction with outer barrier walls.

FIG. 2 is a perspective view of another prior art bassinet 50 as disclosed in U.S. Pat. No. 10,149,551 to Long, which is expressly incorporated herein. The bassinet 50 includes a lower frame 52 defining a support surface for a mattress or other such bed for the baby (not shown). As mentioned above, the lower frame 52 may be supported on a stand for over-the-bed use, or the bassinet 50 may be a standalone, portable item. The bassinet 50 defines a sleigh-shaped enclosure for the baby including a front wall 54, a rear wall 56, and two end walls 58. That is, the walls 54, 56, 58 define the enclosure. At least one of the front wall 54 and rear wall 56 is desirably convertible between its upright orientation shown in FIG. 2 that provides a barrier to a sleeping baby within the bassinet, and a lowered configuration which removes the barrier and permits someone to reach in and care for the baby. It should be understood that the front wall 54 and/or rear wall 56 may be convertible in this respect in any of the embodiments disclosed in U.S. Pat. Nos. 8,429,771 and 9,226,594.

In the illustrated embodiment, the front wall 54 is detachable from the front side of the bassinet 50 and may be slotted into a lower receptacle 60 formed in the frame 52. For example, the front wall 54 may have Velcro strips or patches thereon which matchup with oppositely-configured Velcro strips or patches provided on the front edges of the end walls 58. Likewise, snaps, buttons, and the like may be used. Alternatively, the front wall 54 may be hinged to the horizontal front edge of the frame 52 so that it can be pivoted downward to remove the barrier on that side. Still further, the front wall 54 may be a flexible mesh that can be pushed down with one's arms, as seen in FIG. 3 of U.S. Pat. No. 10,149,551, and is thus convertible between upright and lowered configurations.

FIG. 2 shows the front wall 54 cut away to show a pair of smoothly contoured partial walls 62 that remain in place. Both of these partial walls 62 are mounted just inside and parallel to the respective front and rear walls 54, 56, and are fixed in an upright orientation so as to present a barrier to the baby rolling out of the bassinet. At the same time, the mother or other caregiver can reach in on both ends of the partial walls 62 to care for the baby. That is, there are spaces between both ends of the partial wall 62 and the end walls 58 where there is no barrier and a person's arms can be rested. In one embodiment, the partial walls 62 have a length of approximately 4 to 6 inches, while the entire length of the bassinet 50 is between 25-30 inches.

In the illustrated embodiment, the partial walls 62 comprise gently curving upward arcs that began at relatively flat ends 64 curving upward in a concave manner before reaching inflection points 66 defining the beginnings of a convex upper edge 68. The partial walls 62 may be formed of a relatively rigid material such as a plastic covered with padding to be comfortable to the baby and the caregiver. The partial walls 62 may be firmly mounted in place so as to be non-removable, or may be detachable though capable of providing a firm barrier to keep the baby and the bassinet. For example, lower tabs (not shown) may be inserted into the frame 52 to provide the rigidity and detachability. The partial walls 62 may be formed in an arch shape as shown with a lower opening 70 to facilitate removal.

The presence of the partial walls 62 greatly improves the safety of the bassinet 50. Namely, the mother can lower or remove the front wall 54 and reach both arms into the interior of the bassinet 50 to cuddle or breast-feed the baby, yet the baby remains within the bassinet and is prevented from rolling out by the partial walls 62. If the mother falls asleep, the baby remains separated from the mother's body which eliminates the possibility of the mother rolling onto and suffocating the baby.

Figure 3A:
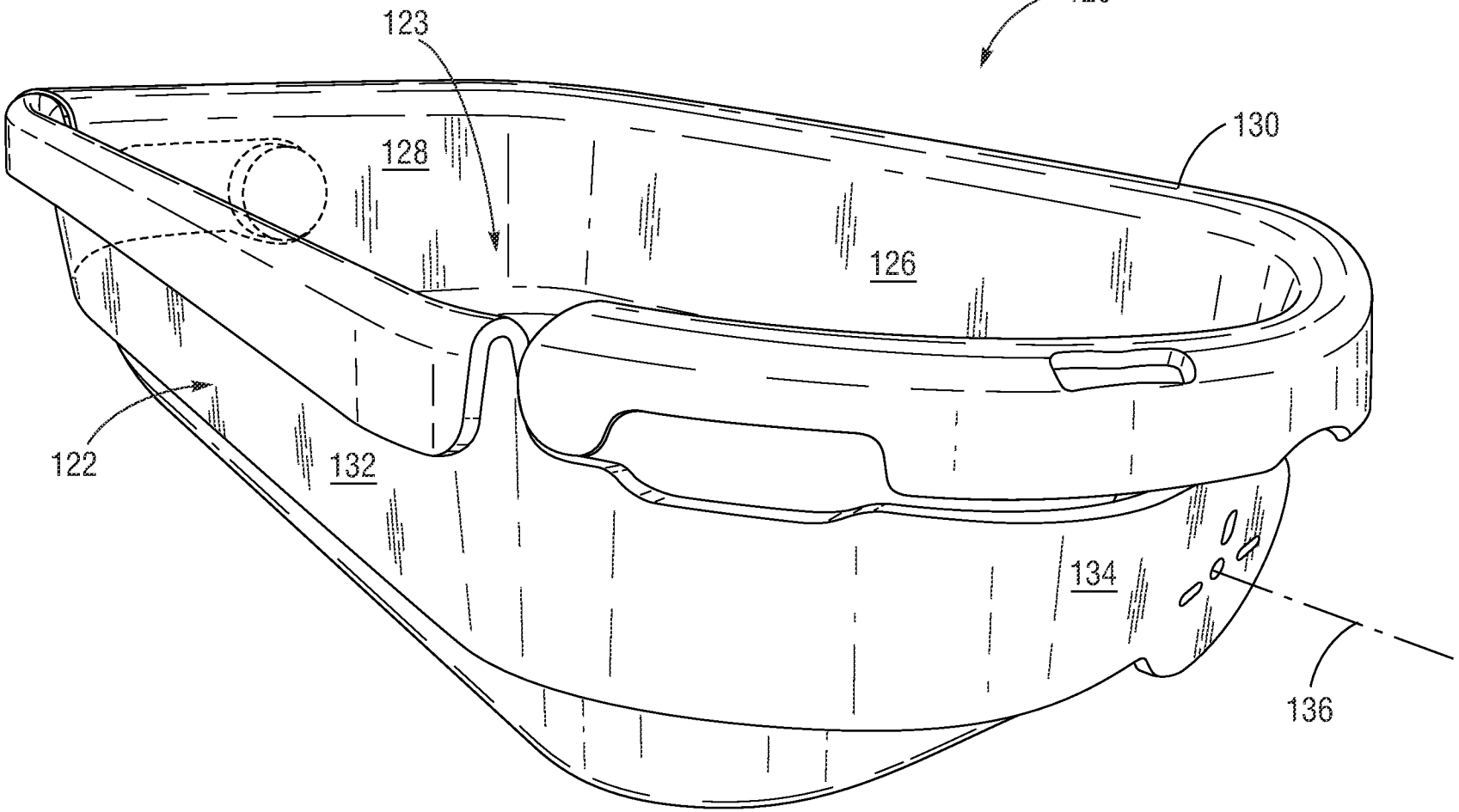
FIG. 3A is a perspective view of an exemplary easy-access bassinet of the present application with a front wall in a raised position.
Figure 3B:
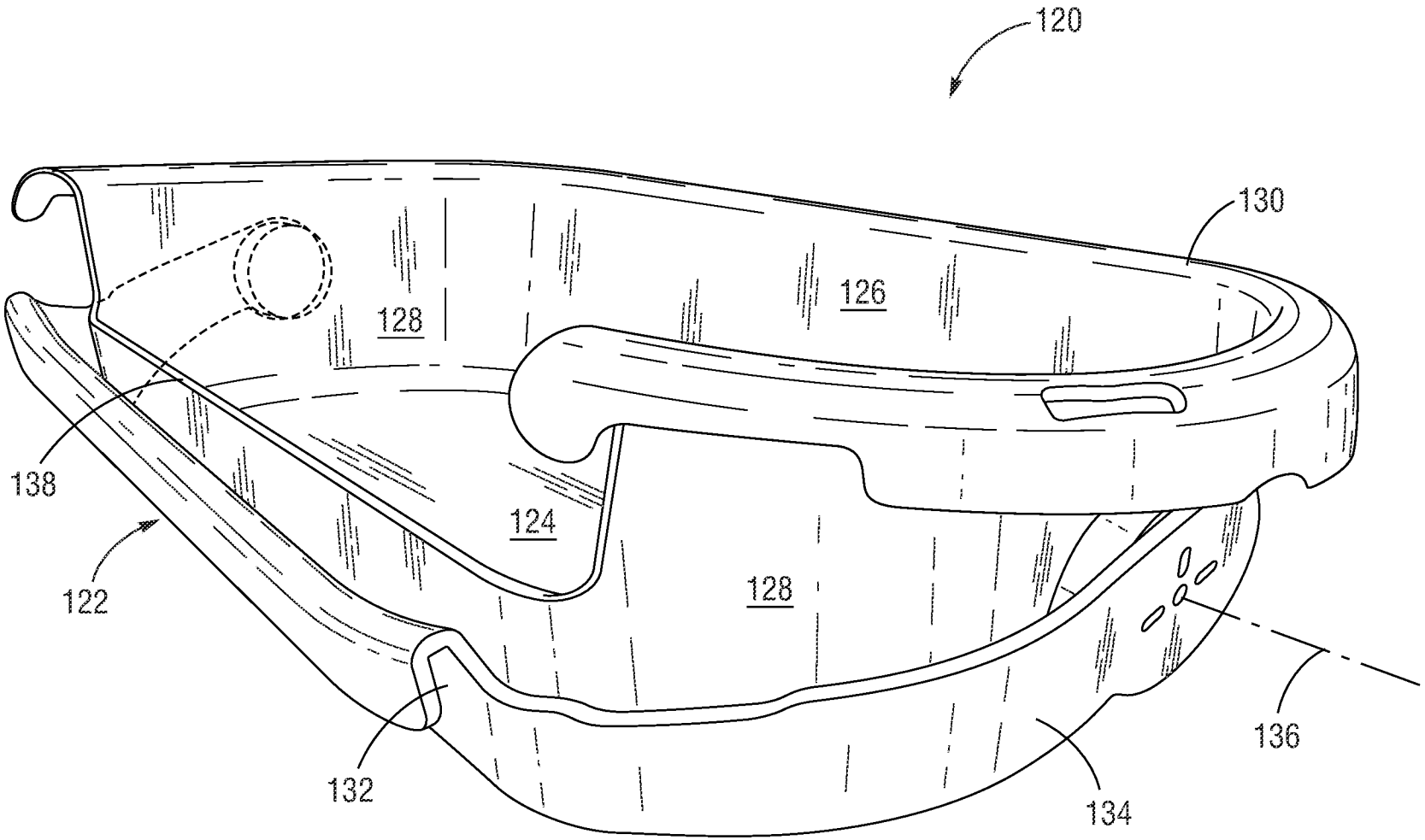
FIG. 3B shows the front wall in a lowered position.
Figure 4B:
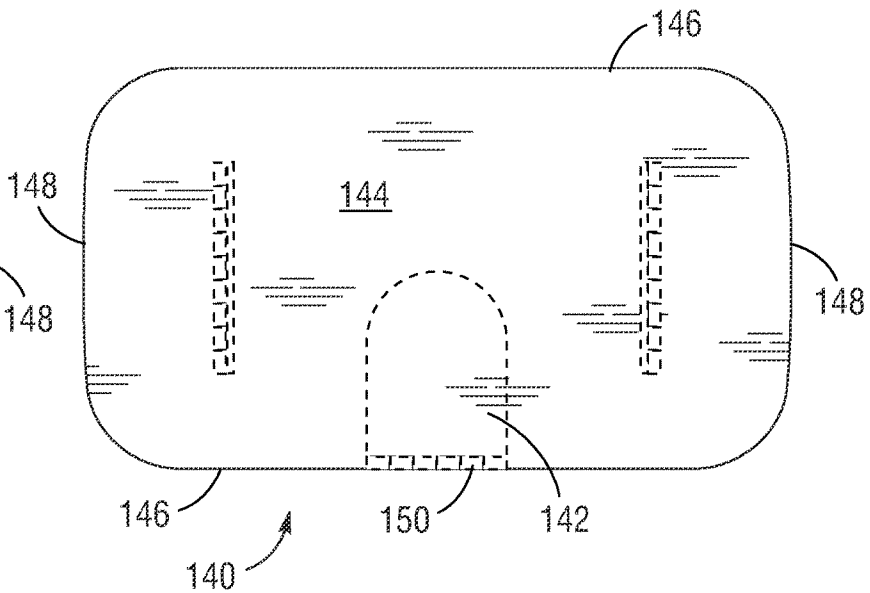
FIGS. 4A-4D are various orthogonal views of an exemplary bassinet adapter of the present application sized to fit within the exemplary bassinet shown in FIGS. 3A-3B.
Figure 4A:
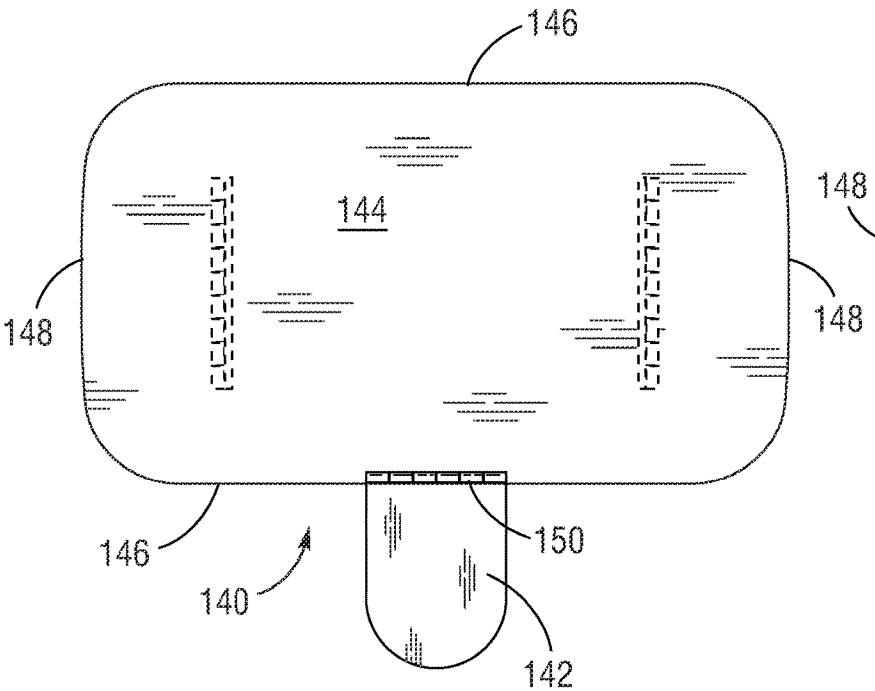
Figure 4D:
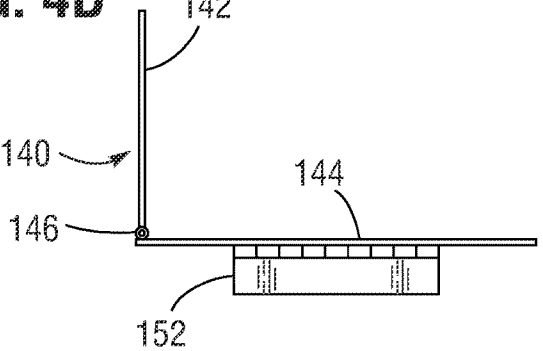
Figure 4C:
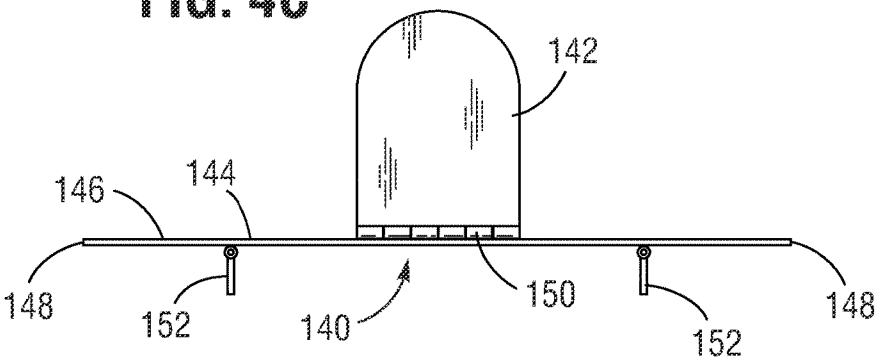

FIGS. 3A and 3B are perspective views of an exemplary easy-access bassinet 120 of the present application shown with a front wall 122 in raised and lowered positions, respectively. The bassinet 120 comprises a series of peripheral barrier walls surrounding an inner cavity 123 above a floor 124. In the exemplary embodiment, the bassinet 120 is generally rectangular in plan view with four peripheral barrier walls. Furthermore, a rear wall 126 and two end walls 128 are fixed, while the front wall 122 is adapted to move between the raised and lowered positions.

In a preferred embodiment, the floor 124, rear wall 126 and two end walls 128 are molded as a single piece of, for example, molded plastic. The front wall 122 is likewise preferably molded plastic. Each of the front wall 122, rear wall 126, and two end walls 128 desirably have rounded upper edges, such as the rolled upper edges 130 that curve approximately 180° to extend downward at terminal ends. The front wall 122 desirably pivots about a horizontal axis 136 extending laterally across the two end walls 128. For example, the front wall 122 may have a generally U-shaped configuration with a lateral front face 132 that curves approximately 90° around on each end to form arms 134 positioned on the outside of the two end walls 128. Hardware (not shown) couples the arms 134 to the end walls 128 to enable pivoting about the common lateral axis 136. In this way, the front wall 122 is adapted to convert between the raised position in FIG. 3A to the lowered position in FIG. 3B.

When the front wall 122 is lowered, as in FIG. 3B, a lowered portion 138 of the peripheral barrier walls of the bassinet 120 is exposed. The lowered portion 138 provides an opening through which the mother can reach into the bassinet 120 to cradle or breast-feed the baby. Preferably, the infant within the bassinet 120 lies on a mattress supported by the bassinet floor 124. The lowered portion 138 desirably has a height which matches or slightly lower than the height of the mattress on the floor 124 so that the mother can rest her arms through the recess created by the lowered portion 138 and onto the mattress without discomfort. The lowered portion 138 forms a fixed front lip for the bassinet that defines a minimal barrier to prevent a sleeping mattress or loose articles within the bassinet, for example, from sliding out.

Furthermore, the hardware that couples the arms 134 to the end walls 128, or via some other mechanism, may provide a restoring force to bias the front wall 122 upward toward the raised position. Various restoring mechanisms have been described previously in U.S. Pat. Nos. 8,429,771 and 9,226,594, which are expressly incorporated herein.

It should be understood that the convertible front wall 122 is representative of a number of different such front walls. For example, the front wall 122 may be solid, as shown, or flexible such as a mesh wall as disclosed in U.S. Pat. No. 10,149,551. Alternatively, the front wall 122 may be a combination of elongated tubes and mesh panels, as also shown in U.S. Pat. No. 10,149,551. In short, the particular configuration of the convertible front wall 122 may vary, and the present application is not considered to be limited to any one.

Figure 7:
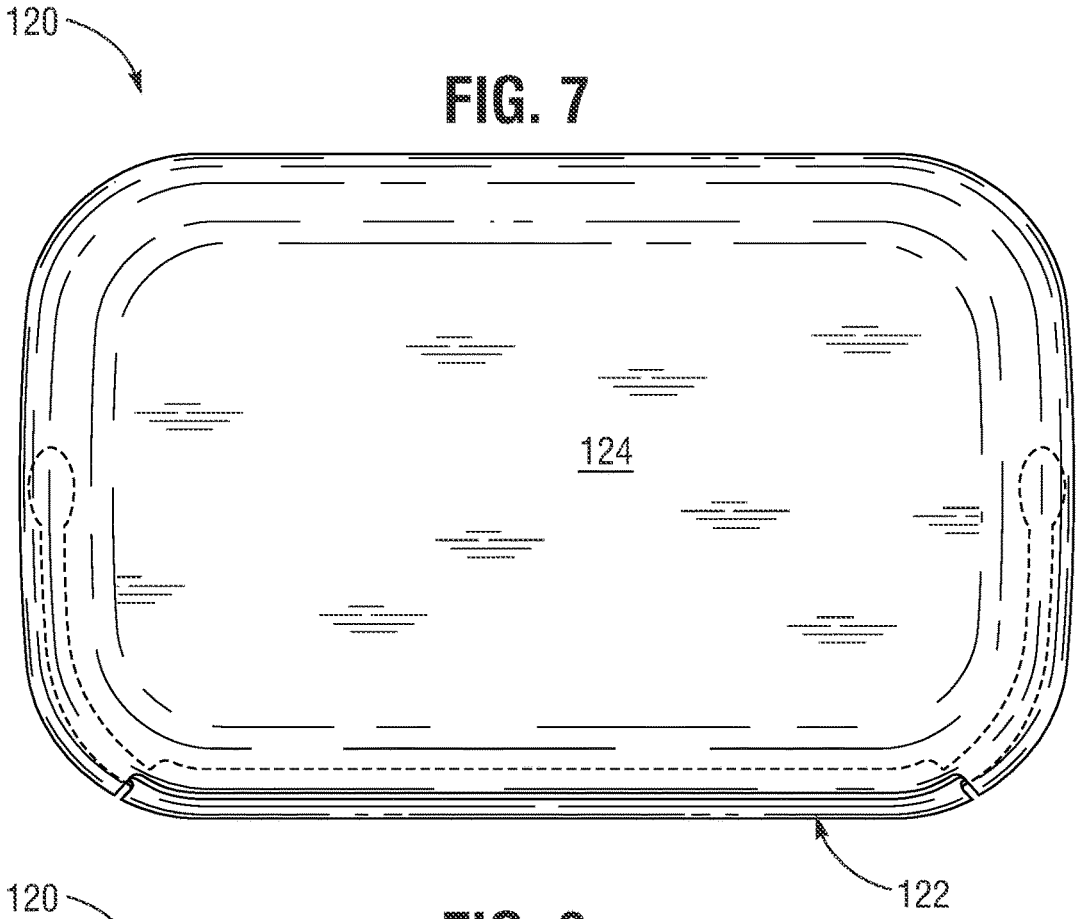
FIG. 7 is a top plan view of the easy-access bassinet of FIGS. 3A-3B.
Figure 8:
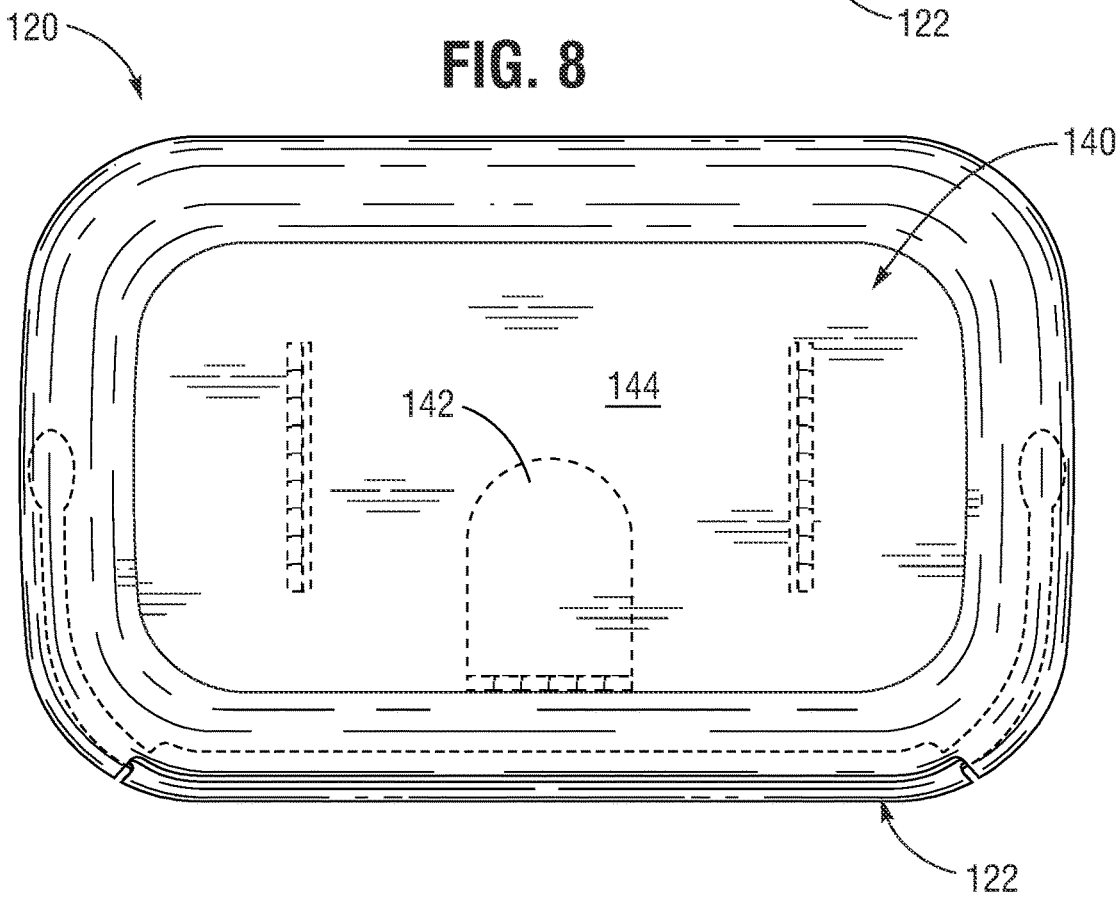
FIG. 8 is a top plan view as in FIG. 7 with the bassinet adapter positioned within the easy-access bassinet.
Figure 9A:
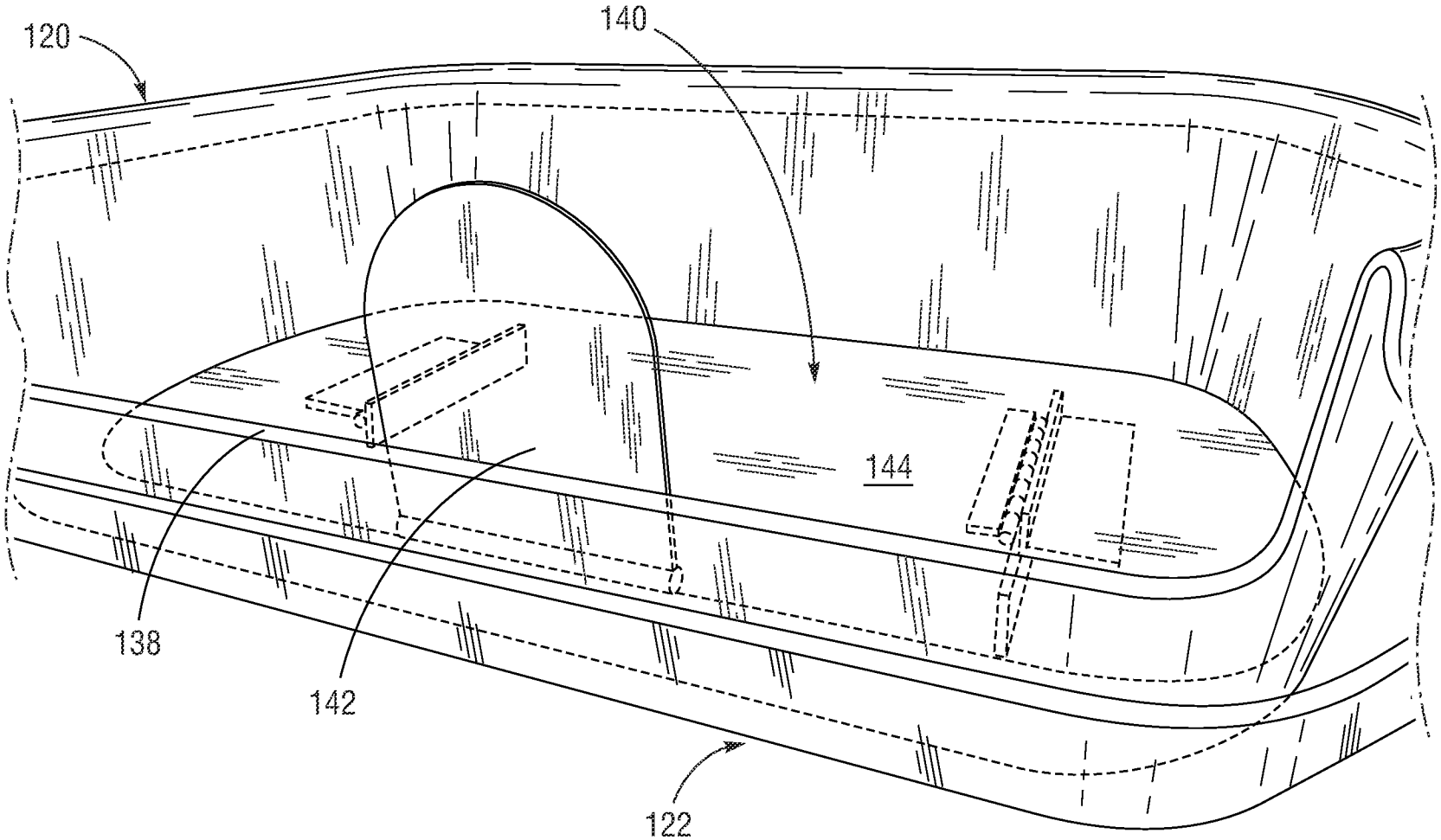
FIGS. 9A and 9B are perspective views of the assembly of the easy-access bassinet and bassinet adapter.
Figure 9B:
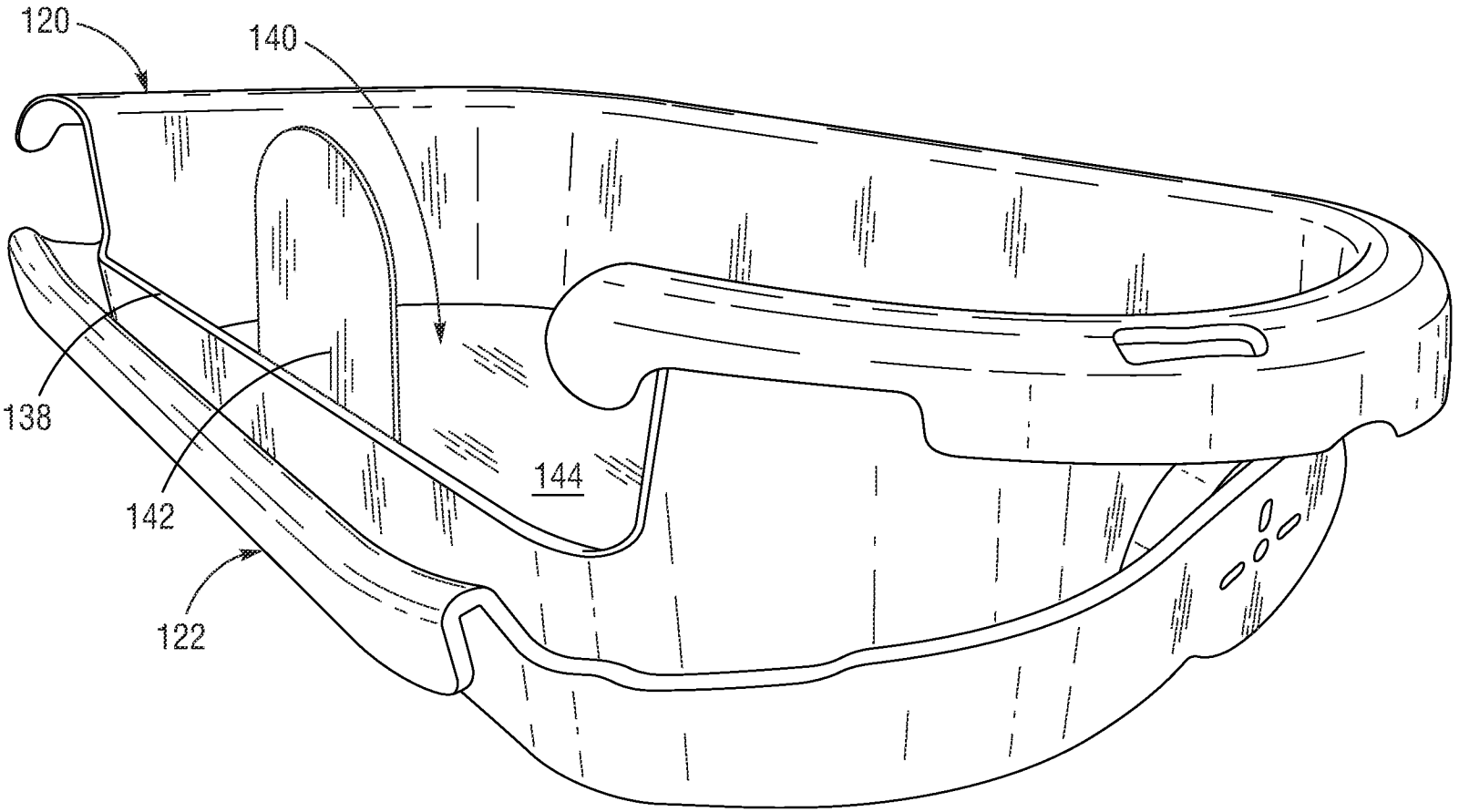

FIGS. 4A-4D are various orthogonal views of an exemplary bassinet adapter 140 of the present application sized to fit within the exemplary bassinet 120 of FIGS. 3A-3B. FIGS. 5A-5B and 6A-6B are upper and lower perspective views of the exemplary bassinet adapter 140 showing a partial barrier wall 142 rotated into two positions—a deployed position and a stored position, respectively. FIGS. 7 and 8 are top plan view of the easy-access bassinet of FIGS. 3A-3B shown prior to and after introduction of the bassinet adapter 140 therein, and FIGS. 9A and 9B are perspective views of the adapter 140 within the bassinet 120.

The bassinet adapter 140 preferably includes a main platform 144 having a peripheral size and shape to fit down within the inner cavity 123 of the bassinet 120 and rest on the floor 124. In the illustrated embodiment, the main platform 144 has a generally rectangular configuration with straight front and rear edges 146, rounded end edges 148, and rounded corners 150 therebetween. The main platform 144 is desirably planar so as to provide an alternative support surface above the bassinet floor 124 for a bassinet mattress, though of course the platform 144 may be slightly convex or otherwise have gently upturned outer edges. In a preferred embodiment, the bassinet adapter 140 is formed of molded plastic components assembled together.

Figure 5A:
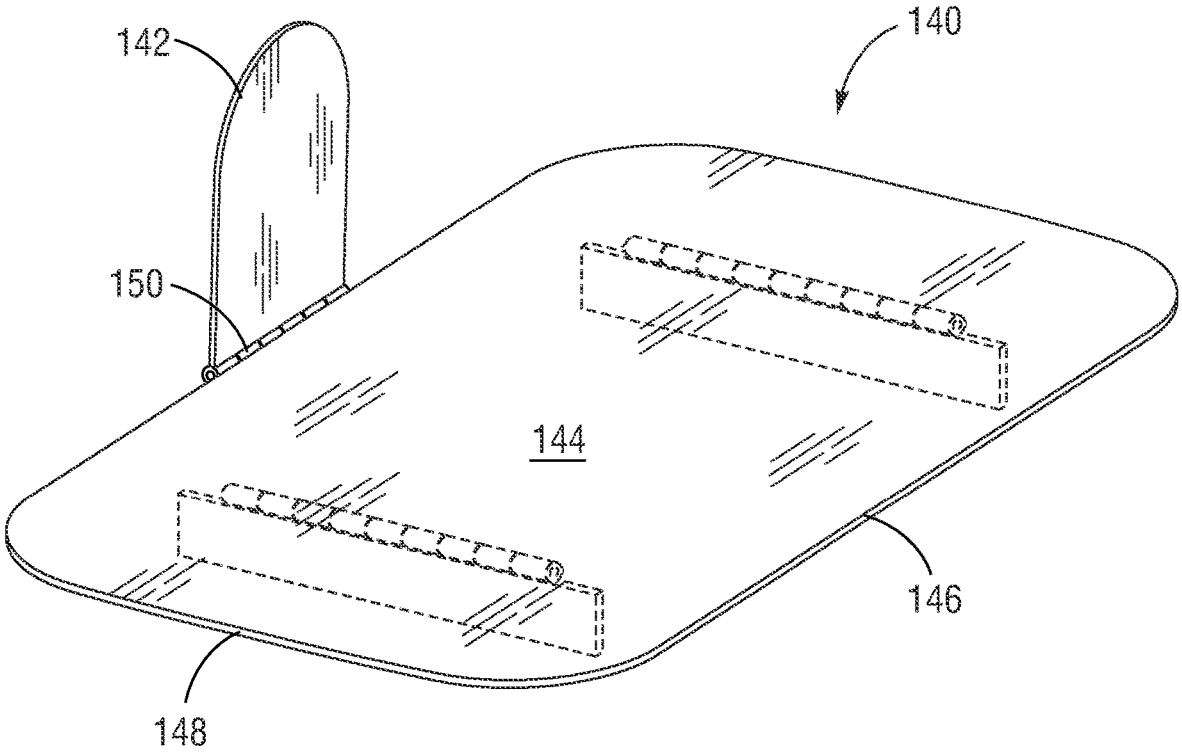
FIGS. 5A and 5B are upper perspective views of the exemplary bassinet adapter showing a partial barrier wall rotated into two positions—a deployed position and a stored position, respectively.
Figure 5B:
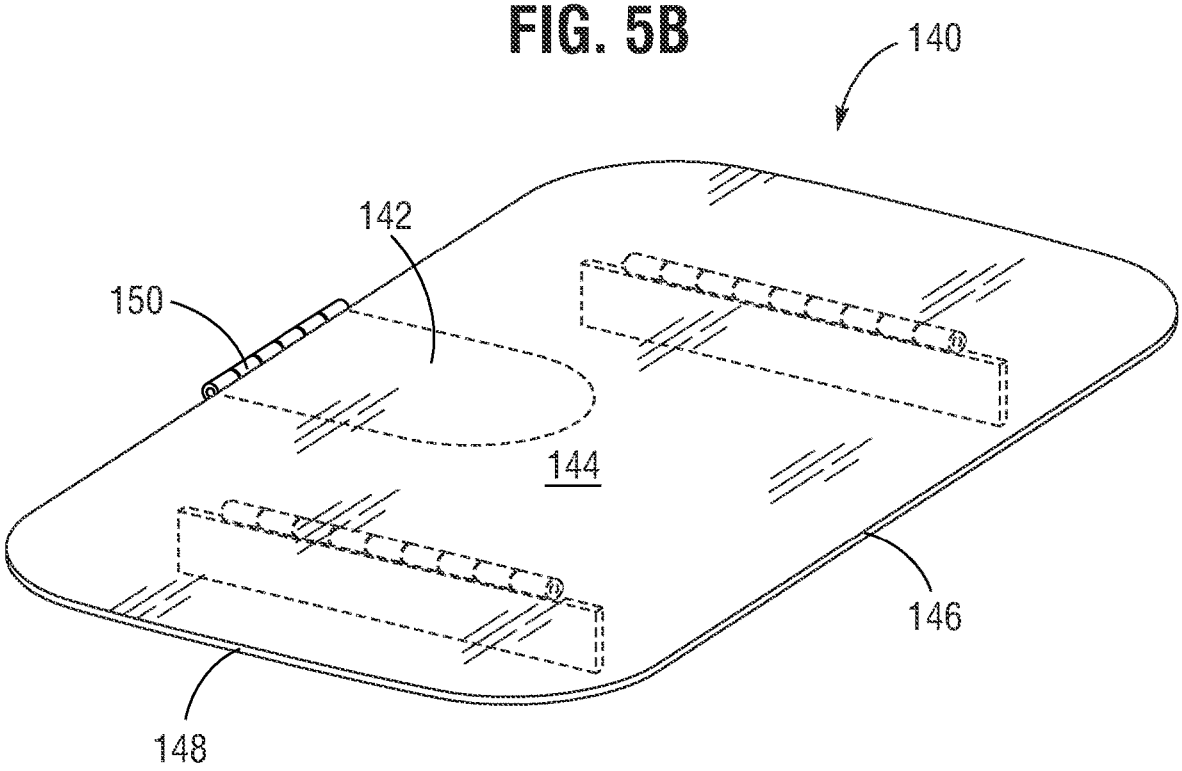

The partial barrier wall 142 rotates about a laterally-oriented hinge 150 located along and parallel to the front edge 146 of the main platform 144. The hinge 150 permits rotation of the partial barrier wall 142 at least between the upstanding deployed position (FIGS. 5A/6A) to the horizontal stored position (FIGS. 5B/6B). In the upstanding deployed position, the partial barrier wall 142 projects upward from the main platform 144 at approximately 90° angle. In the stored position, the partial barrier wall 142 lies underneath and parallel to the main platform 144. The hinge 150 thus permits at least 270° rotation of the partial barrier wall 142, but may provide nearly a 360° rotation if needed. In an alternative embodiment, the partial barrier wall 142 is fixed in the upstanding deployed position by replacing the hinge 150 with a solid 90° junction with the main platform 144.

Figure 6A:
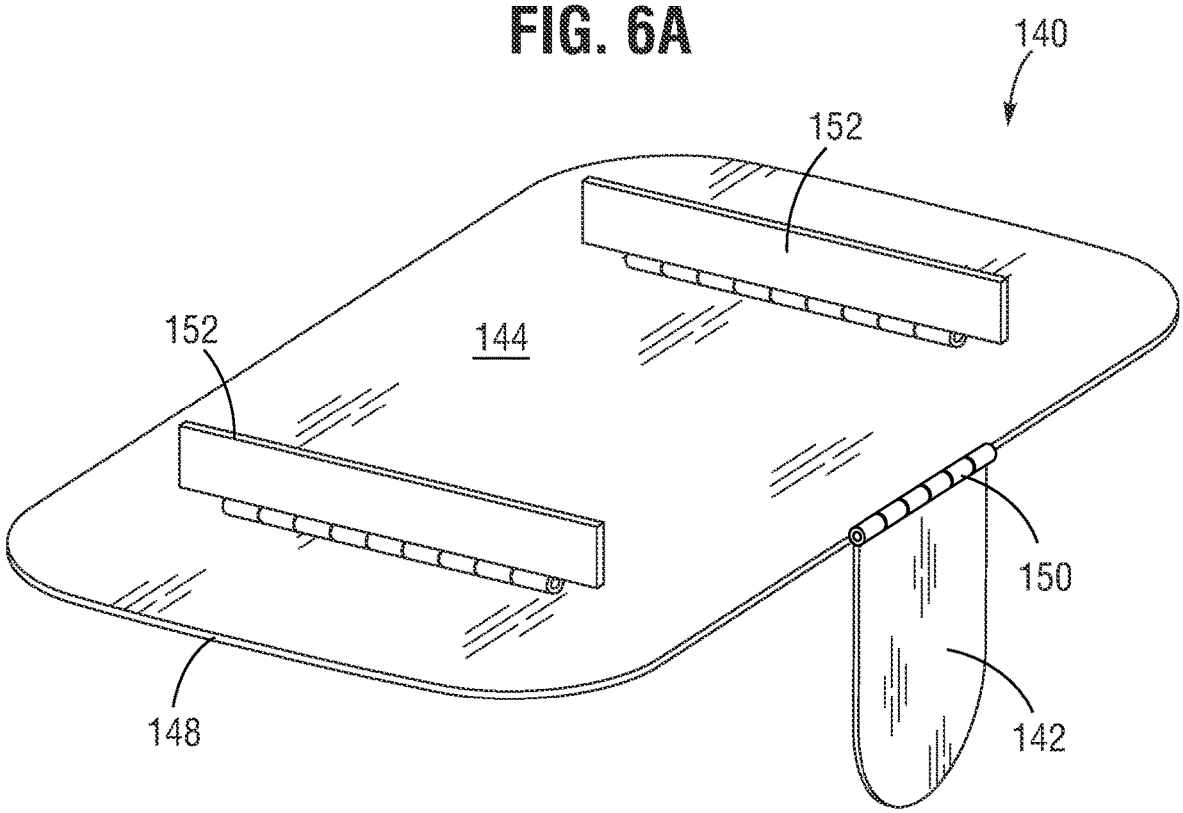
FIGS. 6A and 6B are lower perspective views of the bassinet adapter showing the partial barrier wall in the deployed and stored positions, respectively.
Figure 6B:
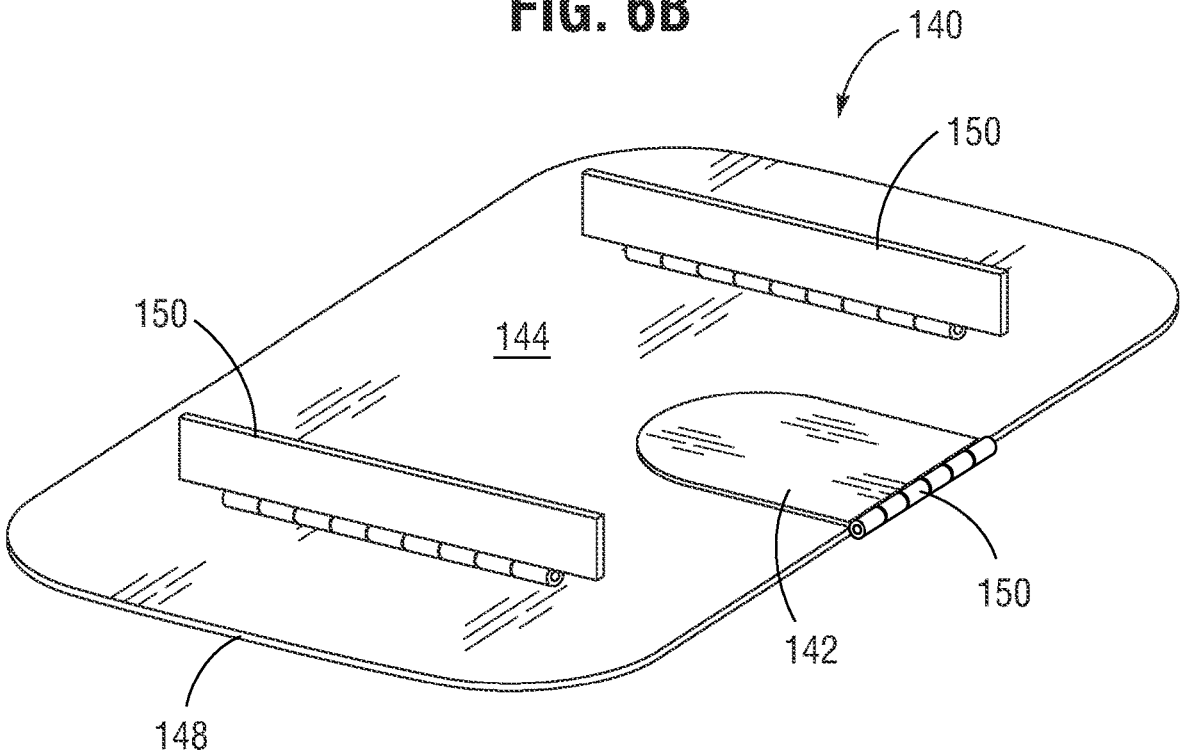

In a preferred embodiment, as best seen in FIGS. 6A-6B, the bassinet adapter 140 further includes a pair of elevating legs 152. The legs 152 are desirably convertible and rotate at least 90° about hinges 154 mounted to the underside of the main platform 144. In this way, the legs 152 can be rotated flat against the underside of the main platform 144 to provide a more compact flattened adapter 140 for storage and shipping. For instance, the flattened adapter 140 might be stored under the bassinet 120 or on a travel cart for the bassinet for optional use. However, it should be understood that the legs 152 may also be fixed in a 90° position pointing downward from the main platform 144. The legs 152 are provided to raise up platform 144 within the bassinet 120 so the top of the infant's mattress is flush with the lowered front wall 122 of the bassinet. The preferred height is also dependent on the bassinet design, and the adapter 140 may be provided with a means for varying the height of the main platform 144 relative to the bassinet walls, such as several sets of rotating legs 152 of differing heights. Since some bassinets have built-in mattresses, the term "sleeping platform" will be used to define the surface on which the instant lies within the bassinet, with or without provision of the removable adapter 140.

FIGS. 7 and 8 are top plan view of the easy-access bassinet 120 shown prior to and after introduction of the bassinet adapter 140 therein, while FIGS. 9A and 9B are perspective views of the assembly of the easy-access bassinet and bassinet adapter. As mentioned, prior to use, a mattress (not shown) will be positioned on the main platform 144 which rises up approximately to the height of the lowered portion 138 on the front of the bassinet. FIG. 8 shows the rotating partial barrier wall 142 lying flush under the main platform 144, while FIGS. 9A and 9B show the barrier wall 142 raised up into its functional position. As explained above, the partial barrier wall 142 prevents the newborn from rolling off of its mattress onto the mother's bed, while the mother's arms may be extended into the bassinet for cradling the newborn or infant, such as while nursing. When the newborn finishes nursing, the mother removes her arm from inside the bassinet, and the front wall 122 may then automatically rise to its upper position.

One benefit of the illustrated configuration is that the partial barrier wall 142 is supported on both sides by the bassinet structure. That is, the partial barrier wall 142 extends upward from below the mattress (not shown) between the mattress and the fixed portion of the front wall 138. This supports the partial barrier wall 142 from the front and from behind, and thus maintains the verticality of the wall.

Preferably, the partial barrier wall 142 has a width of approximately 6-8 inches and a height of 4-6 inches, while the entire length of the bassinet 120 is between 25-30 inches. In general, the partial barrier wall 142 has a width of between about 20-50% of the length of the bassinet, and more preferably between about 30-40%. The upper edge of the barrier wall 142 is desirably rounded, as shown, to avoid any potential danger sharp edges, and may also be padded for further comfort.

Figure 10:
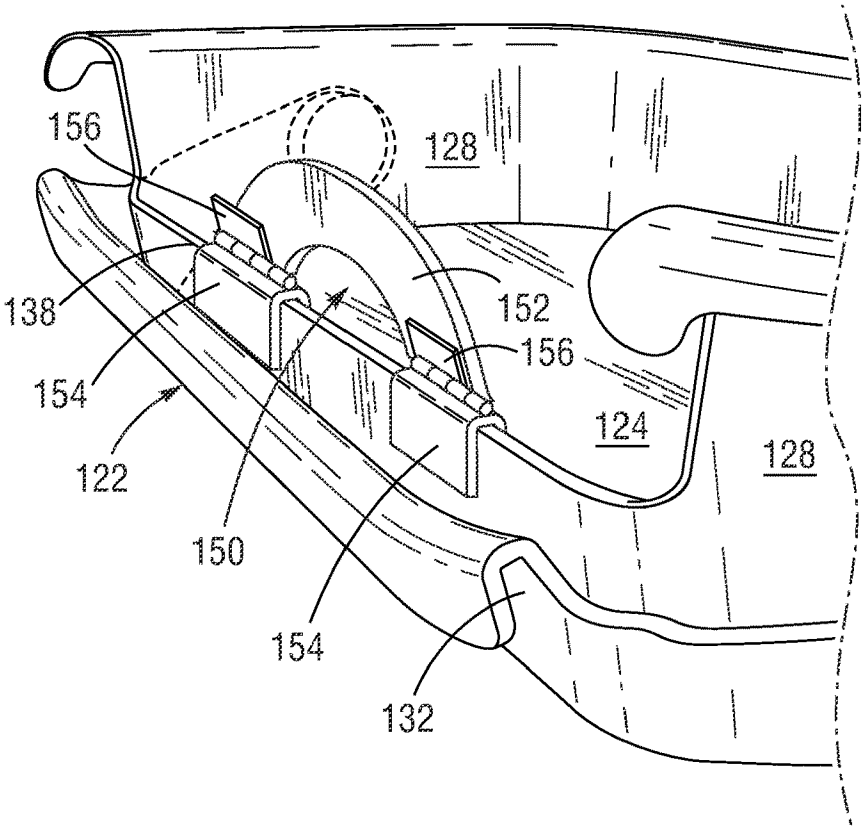
FIG. 10 is a perspective view of an alternative easy-access bassinet having a partial barrier wall is clipped onto a fixed front lip of the bassinet.

FIG. 10 is a perspective view of an alternative easy-access bassinet 120 having a partial barrier wall 150 clipped onto a fixed front lip 138 of the bassinet. The partial barrier wall 150 preferably has an arched shape with a convex upper portion 152 and two lower ends terminating in clamps 154. The clamps 154 may be fashioned with spring-loaded hinges (not numbered) which are loosened by squeezing two tangs 156 projecting upward and outward from the hinges. The partial barrier wall 150 may therefore be easily clipped onto the fixed front lip 138 of the bassinet 120 and left in place whether the front convertible wall 122 is in its raised or lowered positions.

Figure 11:
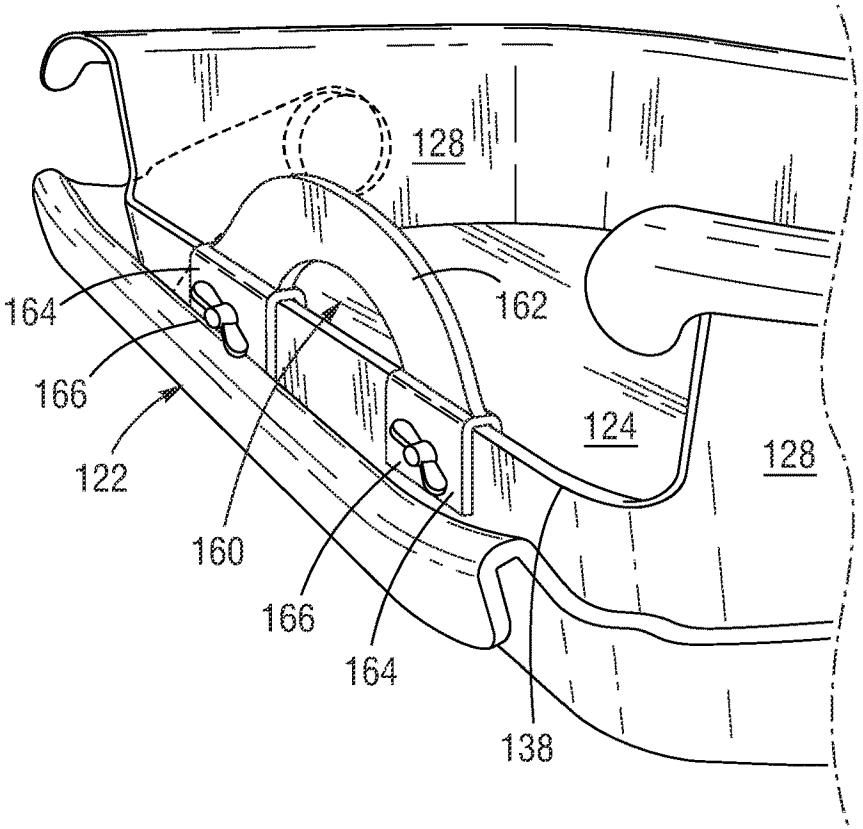
FIG. 11 is a perspective view of another clip-on partial barrier wall similar to that shown in FIG. 10.

FIG. 11 is a perspective view of another clip-on partial barrier wall 160 similar to that shown in FIG. 10, including a convex arch-shaped upper portion 162. The two lower ends terminating in clamps 164. In this embodiment, the clamps 164 define inverted U-shaped channels a fit closely over the fixed front lip 138. Each clamp 164 has a threaded tightener 166, such as an enlarged bolt having a winged head.

Although not shown, FIGS. 10 and 11 represent just two ways to temporarily secure just a partial barrier wall to the front lip 138 of the bassinet 120. For instance, hook and loop (i.e., Velcro) fasteners may also be used for perhaps the fastest way to clip on and take off a partial barrier wall. Likewise, a partial barrier wall that has brackets that simply fit over the front lip 138 in a tight fit may be used, though some way to inhibit removal is preferred. The front lip 138 of the bassinet 120 may also be adapted to receive a partial barrier wall, such as by providing holes or slots through which pins or straps may be passed. In short, the present application contemplates a variety of ways to temporarily support and/or secure a partial barrier wall to a lowered front wall or lip of a bassinet.

Figure 12A:
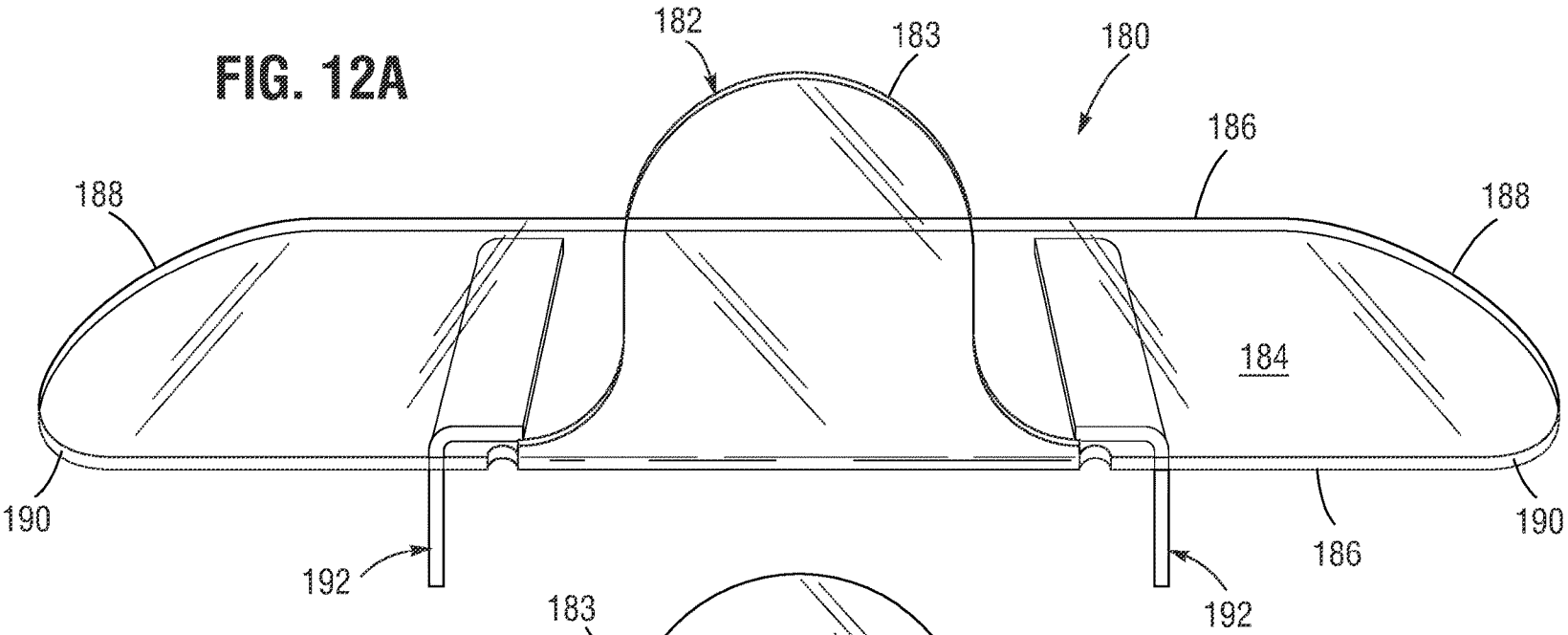
FIGS. 12A and 12B are perspective and front elevational views of an alternative bassinet adapter sized to fit within a bassinet such as shown in FIGS. 3A-3B.
Figure 12B:
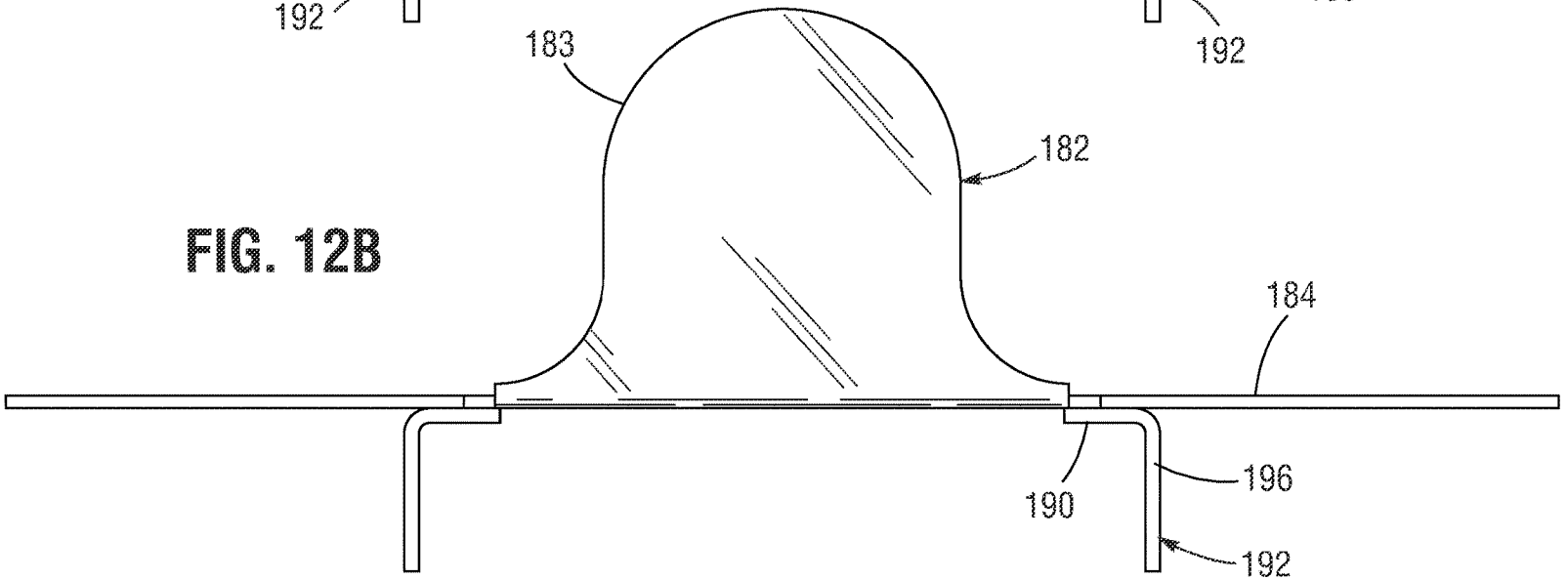

FIGS. 12A and 12B are perspective and front elevational views of an alternative bassinet adapter 180 sized to fit within a bassinet, such as shown in FIGS. 3A-3B. The alternative bassinet adapter 180 is similar to the adapter 140 described above but is constructed to be rigid and to provide more of a permanent adapter for certain bassinets. For example, FIG. 13 is a perspective view of the alternative bassinet adapter 180 fitted within a bassinet 200 showing a partial barrier wall 182 fixed in an upright position.

Much like the first-described adapter, the bassinet adapter 180 preferably includes a main platform 184 having a peripheral size and shape to fit down within an inner cavity of the bassinet 200 and rest on the floor thereof. In the illustrated embodiment, the main platform 184 has a generally rectangular configuration with straight front and rear edges 186, rounded end edges 188, and rounded corners 190 therebetween. The main platform 184 is desirably planar so as to provide an alternative support surface above the bassinet floor for a bassinet mattress, though of course the platform 184 may be slightly convex or otherwise have gently upturned outer edges. In a preferred embodiment, the bassinet adapter 180 is formed of molded plastic components assembled together.

The bassinet adapter 180 further includes a pair of elevating legs 192. The legs 192 are desirably fixed at an orientation of 90° relative to the underside of the main platform 184. In this way, the legs 192 enable the platform 184 to raise up within the bassinet 200 so the top of the infant's mattress may be flush with the lowered front wall 202 of the bassinet. Of course, the two legs 192 are exemplary only, and one of skill in the art will understand that there are numerous similar supports available that could raise the platform 184 up within the bassinet to a desired height, such as 4 vertical posts near the corners of the platform. The preferred height is again dependent on the bassinet design, and the adapter 180 may be provided with a means for varying the height of the main platform 184 relative to the bassinet walls, such as several sets of legs of differing heights which may be adjusted. The legs 192 may be formed as angled beams which have a horizontal component 194 and a vertical component 196, with the former being adhered, welded or heat bonded to the underside of the main platform 184.

Figure 13:
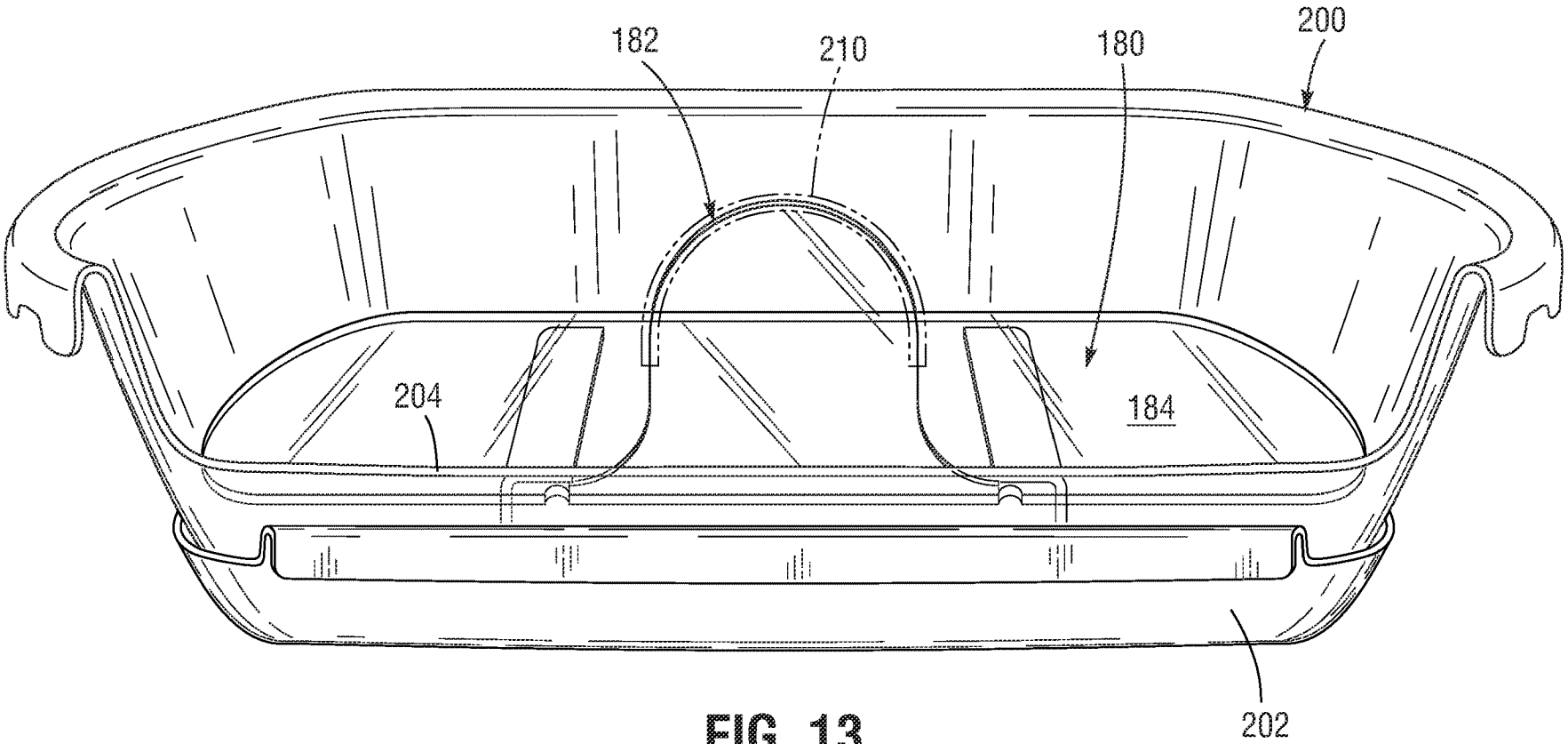
FIG. 13 is a perspective view of the alternative bassinet adapter fitted within a bassinet.

As seen in FIG. 13, the level of the platform 184 is preferably slightly below the top edge of the convertible front wall 202 in its lowered position, or below the fixed front edge 204 of the frame of the bassinet 200. Consequently, a mattress may be added to form a sleeping platform for the infant which is level with the top edge of the front wall 202 or the fixed front edge 204. The mother can thus reach into the bassinet cavity and cradle the infant as well as breast feed. Since some bassinets have built-in mattresses, the term "sleeping platform" will be used to define the surface on which the infant lies within the bassinet, with provision of the removable adapter 180 and secondary mattress. It should be understood that the rigid convertible front wall 202 as shown is exemplary only, and as disclosed in U.S. Pat. No. 10,149,551 to Long, expressly incorporated herein, various convertible walls are contemplated. For instance, the front wall 202 may be formed of a mesh rather than being rigid.

The partial barrier wall 182 is fixed at a 90° angle with respect to the front edge 186 of the main platform 184. In this position, the partial barrier wall 182 projects upward from the main platform 184. The partial barrier wall 182 is fixed in the upstanding position with a solid 90° junction with the main platform 184. The partial barrier wall 182 preferably has an arch shape with a convex upper portion 183 and two lower sides that gently curve outward to a nearly horizontal orientation. For instance, the partial barrier wall 182 may be integrally molded and machined with the main platform 184 from a single sheet of material, and then bent such as with heat to the perpendicular position. Alternative, the partial barrier wall 182 may be a separate piece which is adhered, welded or heat bonded in the upstanding position to the main platform 184. The partial barrier wall 182 may be angled slightly outward from a perpendicular orientation, such as by up to 10°.

In any configuration described herein, the top edge of the partial barrier wall 182 may be padded or cushioned, such as by adhering foam or an upholstered edge to the barrier wall. An example is shown in phantom in FIG. 13 as padding or cushioning 210. Alternatively, the top edge of the partial barrier wall 182 may be curled outward or inward so that it exhibits a tubular form and is thus smoother and provides comfort if the mother rests her arm on it.

In a preferred embodiment, the components of the bassinet adapter 180 are molded/machined of a homogeneous polymeric material such as polyester or acrylic, but may also be constructed of wood or other such rigid material whose edges are easily smoothed and which has a relatively low heat conductance to avoid cold surfaces.

While the invention has been described in its preferred embodiments, the words which have been used are words of description and not of limitation. Therefore, changes may be made within the appended claims without departing from the true scope of the invention.

What is claimed is:

1. A bassinet adapter for use with a bassinet having a plurality of enclosure walls mounted around a periphery of a floor defining a horizontal plane for supporting a sleeping platform that present a complete barrier to a baby rolling off the sleeping platform when in a raised configuration, at least one of the enclosure walls being a convertible wall configured to move from a raised position to a lowered position at or below the level of the sleeping platform, the adapter comprising:

a removable bassinet adapter having a planar main platform without sidewalls and having outer edges that fits flat on the floor and the outer edges fit closely within the enclosure walls define by the bassinet, the adapter having a single partial barrier wall extending upward about 90° relative to the plane of the floor from a front edge of the main platform so as to be positioned within the convertible wall, the partial barrier wall extending upward from the convertible wall in the lowered position to present a partial barrier to a baby on the sleeping platform rolling out of the bassinet.

2. The bassinet adapter of claim 1, wherein the partial barrier wall is padded.

3. The bassinet adapter of claim 1, wherein the enclosure walls define a generally rectangular shape for the bassinet having a length and a width, and the partial barrier wall has a length of between about 20-50% of the length of the bassinet.

4. The bassinet adapter of claim 1, wherein the partial barrier wall has a convex curved upper edge.

5. The bassinet adapter of claim 4, wherein the convex curved upper edge is padded.

6. The bassinet adapter of claim 1, wherein the bassinet adapter further includes a pair of legs extending downward from the main platform for spacing the main platform up above the bassinet floor.

7. The bassinet adapter of claim 6, wherein the legs are pivotable relative to the main platform so as to be pivoted flat underneath and parallel to the main platform.

8. The bassinet adapter of claim 1, wherein the partial barrier wall is fixed in a 90° orientation relative to the main platform.

9. The bassinet adapter of claim 1, wherein the partial barrier wall is pivotably connected to the front edge of the main platform so as to be configured to pivot at least 270° from the position extending upward from the front edge to a retracted position lying underneath and parallel to the main platform.

10. A bassinet adapter for use with a bassinet having a plurality of enclosure walls mounted around a periphery of a floor defining a horizontal plane for supporting a sleeping platform that present a complete barrier to a baby rolling off the sleeping platform when in a raised configuration, at least one of the enclosure walls being a convertible wall configured to move from a raised position to a lowered position at or below the level of the sleeping platform, wherein the bassinet defines a fixed front lip extending parallel to the convertible wall and lower than the convertible wall in the raised position, the adapter comprising:

a removable bassinet adapter defining a single partial barrier wall extending upward about 90° relative to the plane of the floor, the partial barrier wall extending upward above the fixed front lip and above the convertible wall in the lowered position to present a partial barrier to a baby on the sleeping platform rolling out of the bassinet, wherein the partial barrier wall is rigidly connected about 90° relative to a front edge of a planar molded plastic main platform without sidewalls and having outer edges that fits flat on the floor so that the outer edges fit closely within the enclosure walls defined by the bassinet.

11. The bassinet adapter of claim 10, wherein the partial barrier wall is padded.

12. The bassinet adapter of claim 10, wherein the enclosure walls define a generally rectangular shape for the bassinet having a length and a width, and the partial barrier wall has a length of between about 20-50% of the length of the bassinet.

13. The bassinet adapter of claim 10, wherein the partial barrier wall has a convex curved upper edge.

14. The bassinet adapter of claim 13, wherein the convex curved upper edge is padded.

15. The bassinet adapter of claim 10, wherein the enclosure walls define a generally rectangular shape for the bassinet having a length and a width, and the partial barrier wall has a length of between about 20-50% of the length of the bassinet.

16. The bassinet adapter of claim 10, wherein the partial barrier wall has a convex curved upper edge.

17. The bassinet adapter of claim 10, wherein the convex curved upper edge is padded.

18. The bassinet adapter of claim 17, wherein the partial barrier wall is padded.

19. The bassinet adapter of claim 10, wherein the bassinet adapter further includes a pair of legs extending downward from the main platform for spacing the main platform up above the bassinet floor.

20. The bassinet adapter of claim 19, wherein the legs are pivotable relative to the main platform so as to be pivoted flat underneath and parallel to the main platform.

* * * * *